US005472240A

United States Patent [19]

Davies

[11] Patent Number: 5,472,240

[45] Date of Patent: Dec. 5, 1995

[54] PRESSURE SEAL POP-UPS

[75] Inventor: Jeffrey T. Davies, Peoria, Ill.

[73] Assignee: Moore Business Forms, Inc., Grand Island, N.Y.

[21] Appl. No.: 280,160

[22] Filed: Jul. 25, 1994

[51] Int. Cl.[6] ..... B42D 15/00

[52] U.S. Cl. ..... 283/116; 156/250; 283/67; 446/148

[58] Field of Search ..... 283/116, 67, 56, 283/117; 462/64; 40/124.1, 411, 539; 156/227, 250; 446/80, 148

[56] References Cited

U.S. PATENT DOCUMENTS

| | | | |
|---|---|---|---|
| 1,089,113 | 3/1914 | Crichton | 283/116 |
| 3,191,328 | 6/1965 | Lohnes . | |
| 3,995,388 | 12/1976 | Penick et al. . | |
| 4,103,444 | 8/1978 | Jones et al. . | |
| 4,146,983 | 4/1979 | Penick et al. . | |
| 4,212,231 | 7/1980 | Penick et al. . | |
| 4,313,270 | 2/1982 | Volkert et al. . | |
| 4,337,589 | 7/1982 | Volkert et al. . | |
| 4,349,973 | 9/1982 | Penick et al. . | |
| 4,657,612 | 4/1987 | Schoenleber et al. . | |
| 4,833,802 | 5/1989 | Volkert . | |
| 4,867,480 | 9/1989 | Volkert . | |
| 4,874,356 | 10/1989 | Volkert . | |
| 4,918,128 | 4/1990 | Sakai . | |
| 5,009,624 | 4/1991 | Estam-Goggin . | |
| 5,078,670 | 1/1992 | Volkert . | |
| 5,096,751 | 3/1992 | Duchek . | |
| 5,238,178 | 8/1993 | Hutchinson et al. . | |
| 5,238,183 | 8/1993 | Suerwine . | |
| 5,253,798 | 10/1993 | Lombardo . | |
| 5,257,823 | 11/1993 | Colvin, Jr. et al. . | |
| 5,271,554 | 12/1993 | Sauerwine . | |
| 5,288,015 | 2/1994 | Sauerwine . | |
| 5,290,385 | 3/1994 | Downing et al. . | |
| 5,421,620 | 6/1995 | Sauerwine | 283/116 |

*Primary Examiner*—Willmon Fridie, Jr.
*Attorney, Agent, or Firm*—Nixon & Vanderhye

[57] ABSTRACT

A pop-up mailer is constructed from a single sheet of 8½×11 or A4 paper having a weight of at least 20 pounds per 1000 sheet ream, using a non-impact printer. The adhesive for holding panels of the sheet together after they are folded about a fold line is preferably a pressure sensitive non-tacky adhesive (pressure coadhesive). At least two pop-ups are die cut from the sheet of paper on opposite sides of a fold line, and pressure coadhesive is used to hold the pop-ups together so that when the mailer is opened a pop-up appears. Adhesive may be applied around the die cut edges to assist in maintaining the pop-ups within the plane defined by the paper during processing. After die cutting, imaging, applying coadhesive, etc., the sheet is folded about a first fold line and passed through a pressure sealer, and then folded about a second fold line transverse to the first fold line and again passed through a pressure sealer, to produce a final mailer to which postage is applied directly.

23 Claims, 5 Drawing Sheets

PRESSURE SEAL POP-UPS

BACKGROUND AND SUMMARY OF THE INVENTION

It has long been recognized that greeting cards or like paper items which are intended to convey a message to a viewer have enhanced attention drawing characteristics if a part of the card "pops up" from the plane of the card upon opening. While the use of "pop-ups" is an effective attention gathering technique, normally the procedures for printing, constructing, and mailing pop-up cards have been complex and expensive enough so as to discourage their use for common mailings—that is, they are typically used only on special occasions (such as shown in U.S. Pat. Nos. 3,995,388 and 4,867,480).

According to the present invention a method, mailer, and an intermediate for a mailer, are provided which facilitate the use of the concept of "pop-ups" with common mailings. One of the most important features of the present invention in order to allow it to accomplish this objective is the ability to make the pop-up mailing of a single sheet of 8½×11 paper, or other standard size paper (e.g. A4). According to the invention it is also possible to variably print the sheet on a non-impact (typically laser) printer so as to customize the sheet and make it suitable as a business mailer, and the sheet itself is constructed into a mailer that does not require a separate envelope. Thus, according to the present invention a mailer is produced that is versatile, simple, and cost effective for common mailings.

The adhesive that is used in the practice of the method and construction of the mailer according to the present invention is a pressure sensitive non-tacky adhesive such as shown in U.S. Pat. No. 4,918,128 (the disclosure of which is hereby incorporated by reference herein), and such as sold commercially by Toppan Moore Co., Ltd. under the trade designation "TN-124". As used in the present specification and claims the term "pressure coadhesive" refers to a pressure sensitive non-tacky adhesive, such as shown in said U.S. Pat. No. 4,918,128, sheets with pressure coadhesive applied being imminently suited for use with laser or other heat-applying printers without the heat applied by the printer in fusing the toner causing the adhesive to become tacky.

According to one aspect of the present invention, a method of making a pop-up mailer from a quadrate single sheet of paper having a front face and a back face, longitudinal edges and transverse edges, is provided. The method comprises the steps of: (a) Die cutting at least two pop-ups from the quadrate sheet of paper. (b) Forming a first fold line separating the two pop-ups from each other. (c) Applying pressure coadhesive to the front face of a portion of at least one of the pop-ups. (d) Applying pressure coadhesive to the front face adjacent at least one longitudinal edge. (e) Applying pressure coadhesive to the back face of the sheet adjacent at least one longitudinal and one transverse edge thereof. (f) Forming a second fold line perpendicular to the first fold line. (g) After steps (a)–(f), folding the sheet about one of the first and second fold lines to bring portions of the back face into contact with each other to form an intermediate. (h) After step (g), applying pressure to the intermediate to seal the intermediate. (i) After step (g), folding the sheet about the other of the first and second fold lines to bring the portions of the front face containing the at least two pop-ups into contact with each other. And (j) after step (i), applying pressure to the folded sheet to seal the front face portions into contact with each other, and the portions of the pop-ups with coadhesive to each other to produce a mailer.

The mailer produced according to the method described above is suitable for mailing as is—that is, postage may be applied directly to the mailer, and it may be mailed, without the need for inserting it into an envelope. Typically, the pressure applying process for sealing the adhesives is a consecutive process, with step (i) practiced after step (h), although under some circumstances steps (g) and (i) may first be practiced and then steps (h) and (j) practiced at the same time (e.g. by a single pass through a pressure sealer, such as available from Moore Business Forms of Lake Forest, Ill. under the trademark "SpeediSealer", and such as shown in U.S. Pat. Nos. 5,133,828, 5,169,489 and 5,183,527.

Utilizing the technique set forth above, a mailer is formed in much the same way that standard business forms with pressure coadhesive are formed, such as shown in U.S. Pat. Nos. 5,174,493 and 5,201,464 (the disclosures of which are hereby incorporated by reference herein).

Step (a) may be practiced before steps (b) through (f). Where step (a)—the die cutting—is practiced early in the processing, it is desirable to apply adhesive (such as pressure coadhesive) around the die cut edges to assist in maintaining the pop-ups within the plane defined by the paper sheet during the practice of subsequent steps. The adhesive bond so provided is not secure enough to prevent pop-ups from popping out of the plane of the paper when the final mailer is opened. Alteratively, instead of using adhesive around the die cuts, small paper ties may be provided at the die cut edges during the die cutting process.

The method also preferably comprises the further step (k) of non-impact imaging (typically with a laser printer) the front face of the sheet with variable indicia prior to the practice of step (g), and most desirably the still further step (l) of non-impact imaging the pop-ups on the back face of the sheet, human readable indicia being provided in both imaging steps. The sheet of paper is typically an 8½×11 or A4 sheet, such as an optical character reader (OCR) quality, having a weight of at least 20 pounds per 1000 sheet ream (typically 24 pounds).

The method may also comprise the further step of forming perf lines adjacent, but spaced from, the longitudinal edges. In this case step (b) is practiced to apply pressure coadhesive between the perf lines and the longitudinal edges, and step (f) is practiced by applying the second fold line parallel to the transverse edges and essentially bisecting the longitudinal edges, and step (g) is practiced by folding about the second fold line and step (i) by folding about the first fold line.

According to another aspect of the present invention a mailer per se is provided. The mailer comprises the following elements: A first ply having an outer face and an inner face. A second ply having first and second faces, the first face in face-to-face engagement with the inner face of the first ply. First human readable indicia on the first ply outer face. A first pattern of pressure coadhesive holding the first ply inner face to the second ply first face. The second ply having first and second panels separated by a fold line. Second human readable indicia on at least one of the panels of the second ply second face. A first pop-up formed in the first panel and a second pop-up formed in the second panel, each pop-up having a base integral with the first and second panels, respectively. A second pattern of pressure coadhesive holding portions of the first and second pop-ups together at an area spaced from the bases of each. And a third pattern of pressure coadhesive releasably holding the first panel second face to the second panel second face.

Typically the mailer first and second plies are integral along an edge thereof, the mailer formed from the single sheet of paper such as paper having a weight of at least about 20 pounds per 1000 sheet ream. Also perforation lines may be provided in the first and second plies adjacent, but spaced from, edges thereof parallel to the fold line, and the third pattern of pressure coadhesive is between these edges and the perforation lines. A predetermined postage application area may be provided on the first ply outer face, and a fold assist perf may be provided in at least one of the pop-ups, and at the pop-up bases, to facilitate proper movement of the pop-up into desired pop-up configuration when the mailer is opened.

According to yet another aspect of the present invention an intermediate for a mailer is provided, the intermediate comprising: A single quadrate sheet of paper having longitudinal edges, transverse edges perpendicular to the longitudinal edges, a front face, and a back face. A first fold line parallel to the longitudinal edges and essentially bisecting the transverse edges. A second fold line parallel to the transverse edges and essentially bisecting the longitudinal edges. A first pattern of pressure coadhesive on the back face including adjacent at least one of the longitudinal edges and adjacent at least one of the transverse edges. At least first and second die cut pop-ups formed on aligned on opposite sides of one of the fold lines, each having a base integral with the sheet. A second pattern of pressure coadhesive on at least one of the first and second pop-ups remote from the base thereof. Human readable indicia on the front face, and on the back face of at least one of the pop-ups. And a third pattern of pressure coadhesive on the front face adjacent at least one of the longitudinal or transverse edges.

The single sheet of quadrate paper typically comprises an approximately 8½×11 inch or A4 sheet having a weight of at least 20 pounds per a 1000 pound sheet ream, but less than greeting card weight. The first and third patterns of pressure coadhesive are preferably adjacent and parallel to longitudinal edges of the sheet, and pop-ups are on opposite sides of the first fold line; and perforation lines are provided parallel to the longitudinal edges on the opposite side of the first and third patterns of pressure coadhesive from the longitudinal edges.

According to still another aspect of the present invention, a method of making a pop-up mailer from a quadrate single sheet of paper having a front face and a back face, longitudinal edges and transverse edges, is provided comprising the steps of: (a) Die cutting at least two pop-ups from the quadrate sheet of paper. (b) Forming a first fold line separating the two pop-ups from each other. (c) Applying adhesive to the front face of a portion of at least one of the pop-ups. (d) Applying adhesive to the front face adjacent at least one longitudinal edge. (e) Applying adhesive to the back face of the sheet adjacent at least one longitudinal and one transverse edge thereof. (f) Forming a second fold line perpendicular to the first fold line. (g) Applying adhesive around the die cuts produced in the practice of step (a) to assist in maintaining the pop-ups within the plane defined by the paper sheet during the practice of subsequent steps. (h) Folding the sheet about the first and second fold lines; and (i) sealing the adhesive to produce a mailer. After step (i) postage is applied directly to the mailer, and it is mailed, no envelope being required.

It is the primary object of the present invention to provide a method of production of the mailer, an intermediate for a mailer, and a mailer which can be simply, easily, and cost effectively produced and mailed, so that it is suitable for common mailings, and is not merely restricted to special occasions. This and other objects of the invention will become clear from an inspection of the detailed description of the invention, and from the appended claims.

DETAILED DESCRIPTION OF THE DRAWINGS

Figure 1:
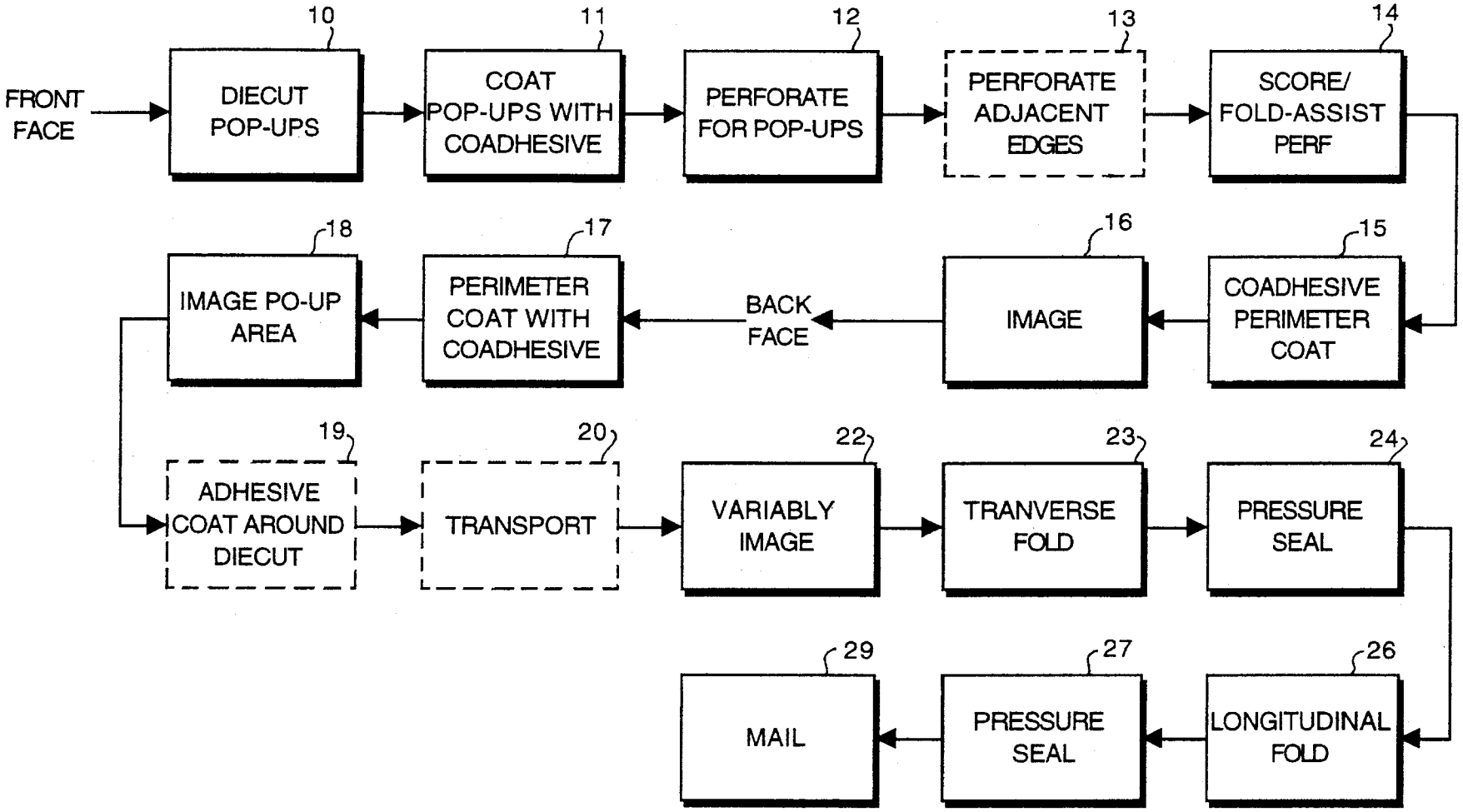
FIG. 1 is a schematic diagram showing the practice of an exemplary method according to the present invention.

An exemplary method for making a mailer according to the present invention is illustrated schematically in FIG. 1. The method is particularly applicable to construction of a mailer from a single sheet of paper, most preferably from a standard 8½×11 or A4 sheet of paper having a weight of at least about 20 pounds, and most preferably 24 pound OCR bond—laser stock, and a weight less than that of conventional greeting cards (e.g. about 35 pounds). Under some conditions, however, especially if only one face is to be imaged, the paper can be 15 pound paper as long as it has sufficient quality to withstand processing of the method of FIG. 1. [The designation "pounds" when referring to paper weight means the approximate weight in pounds of a 1000 sheet ream of paper.]

In the method illustrated in FIG. 1, the illustration is made assuming that the front face is acted upon, and then the back face, of a paper sheet, although it is to be understood that a number of operations (particularly imaging) may be performed substantially simultaneously.

Box 10 illustrates die cutting of pop-ups from the sheet. During die cutting small paper bridges may be left between the pop-up and the surrounding sheet to hold the pop-ups in the plane of the paper during subsequent processing as long as the paper bridges are small enough not to interfere with ultimate pop up function of the pop-ups that have been die cut. Alternatively, the die cuts may be made clean, with no paper bridges.

Box 11 illustrates coating of the pop-ups with pressure coadhesive. A small strip or other pattern of pressure coadhesive is applied to either one or both of the pop-ups, at to-be-aligned portions thereof, using standard equipment for applying pressure coadhesive. There is the optional step 12 of providing a fold assist perf in one or both of the pop-ups, and the optional step 13 of perfing adjacent the longitudinal edges of the sheet to facilitate opening of the sheet to facilitate opening of the final mailer that is produced. In any event, first and second fold assist perfs are formed in the sheet, as indicated by box 14, either by scoring, fold assist perfs formation, or an equivalent step. Pressure coadhesive is also applied to at least one perimeter portion, as indicated by box 15, and any non-variable human readable indicia is imaged on the front face, e.g. by press printing, as indicated by box 16.

On the back face of the sheet, a perimeter coat of pressure coadhesive is provided as indicated by box 17. If desirable or necessary, the pop-up area on the back face (within the die cut) may also be imaged as indicated by box 18, as by press printing. Also, if during die cutting paper bridges are not left, an adhesive coating, such as silicone adhesive or pressure coadhesive, may be provided around the die cut edges—as indicated by box 19—to assist in holding the die cut pop-ups in the plane of the paper during subsequent processing.

Please note that the sequence of steps illustrated in FIG. 1 is not intended to be restrictive, but rather almost any sequence may be provided. For example, the die cutting, as indicated by step 10, may be practiced last, or if practiced first the adhesive coating provided by box 19 may be provided immediately after the die cutting step 10. The exact sequence may be depend upon the particular pop-ups being constructed, how much non-variable imaging is being provided (e.g. in steps 16, 18), the weight of the paper, and a large number of other variables.

Figure 2:
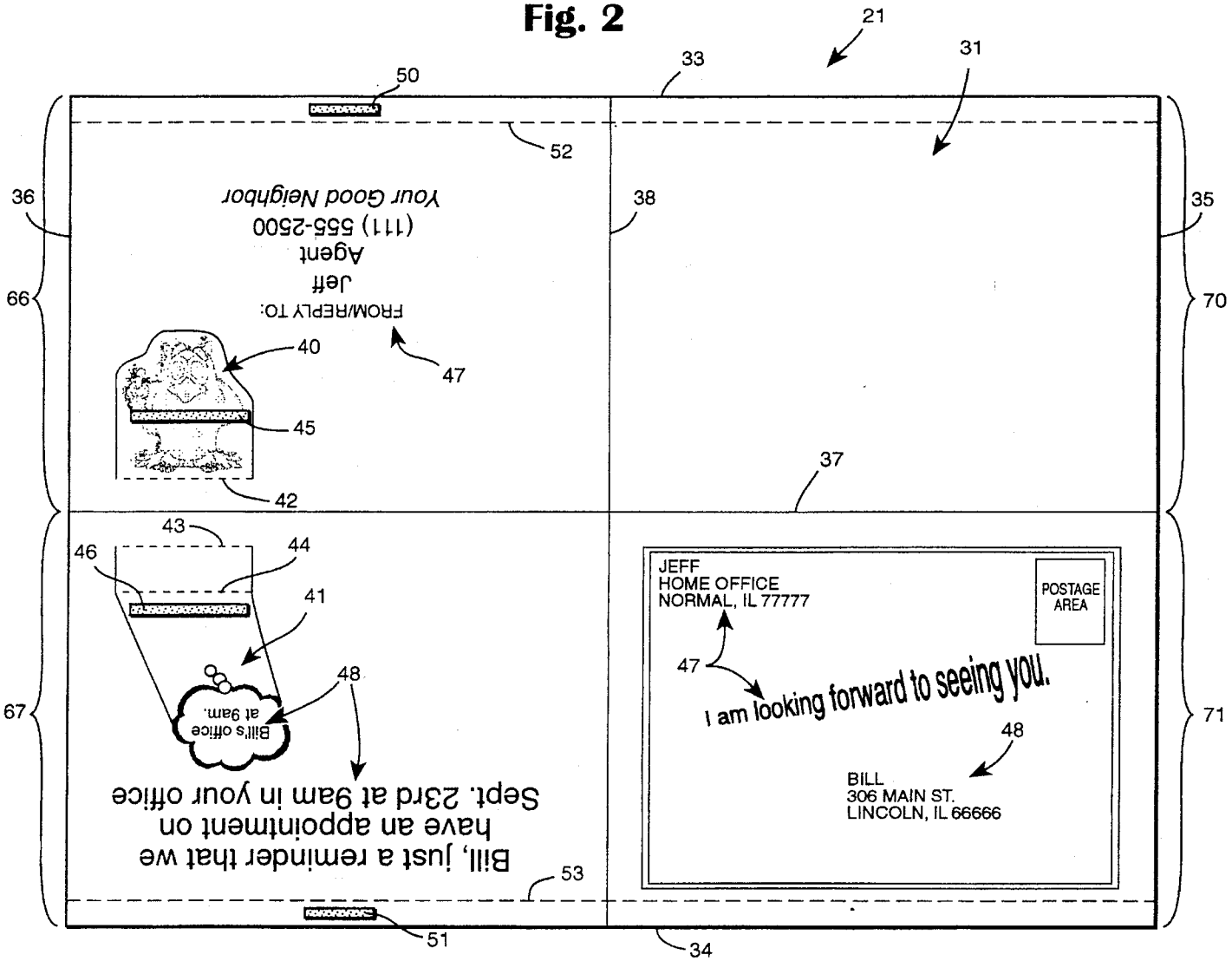
FIG. 2 is a top plan view of the front face of an intermediate for a mailer according to the present invention.
Figure 3:
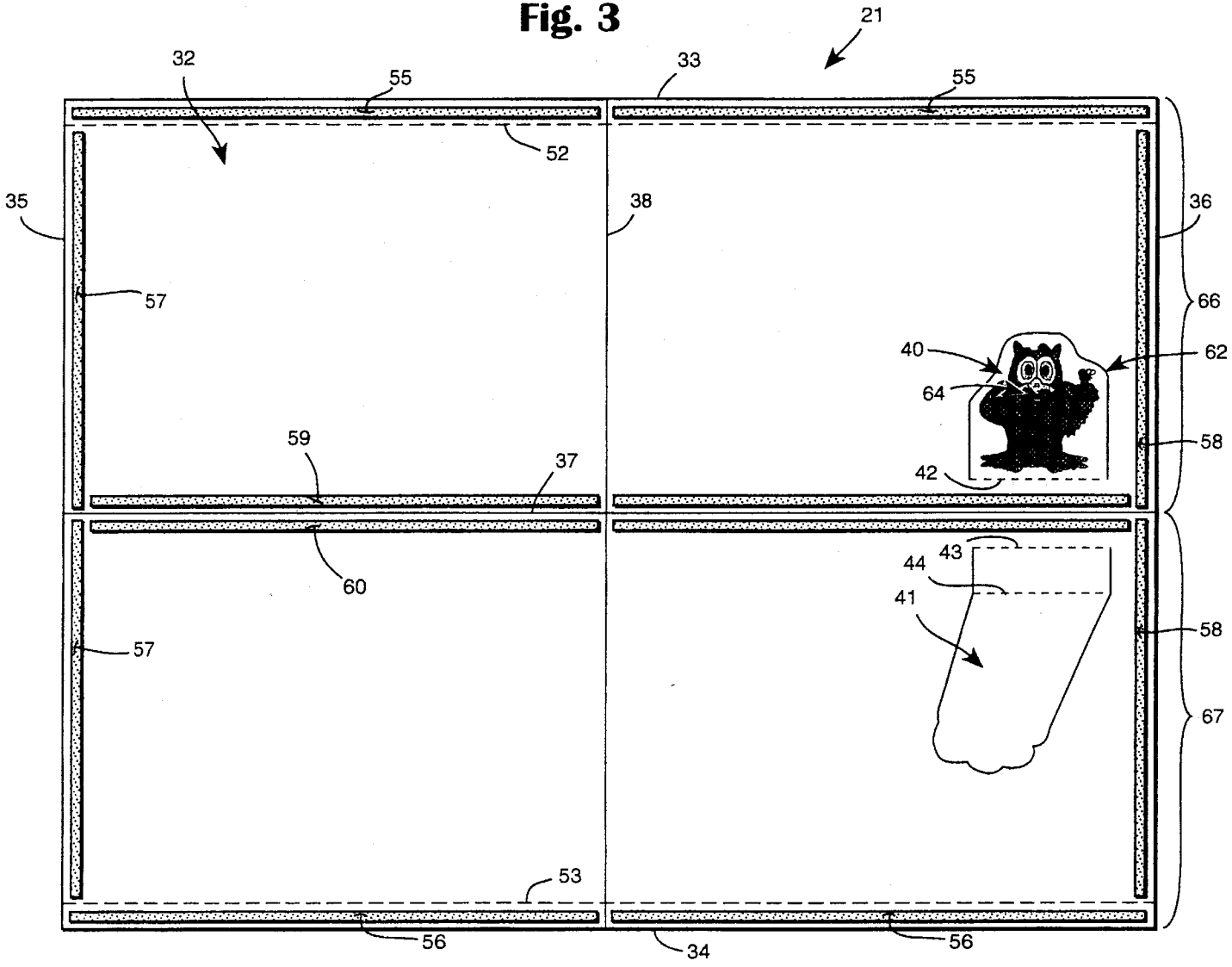
FIG. 3 is the back face of the intermediate of FIG. 2.

Normally, after step 19, an intermediate for a mailer (such as shown in FIGS. 2 and 3) has been produced. This intermediate will then typically be sold to the ultimate customer, being transported to the customer as indicated schematically by box 20 in FIG. 1. However, this is not necessary, and the completion of the operation may be performed at the same site as the steps 10 through 19.

The customer receiving the intermediate 21 (FIGS. 2 and 3) typically will variably image the intermediate 21 utilizing a laser or other non-impact printer, as shown schematically by box 22 in FIG. 1. A customer may variably image both the front and back faces (particularly the back face of the pop-up area), or just the front face. After variably imaging the intermediate 21, the intermediate will then be folded to form the final mailer construction and the pressure coadhesive sealed.

FIG. 1 illustrates one particular sequence of events/steps that may be practiced, although the exact sequence illustrated in FIG. 1 is not critical. In the preferred sequence of FIG. 1, however, the intermediate 21 is folded about a transverse fold line as indicated by box 23, and then passed through a conventional pressure sealer to seal the pressure coadhesive applied in step 17, as illustrated at 24 in FIG. 1. The pressure sealer may be a standard type available from Moore Business Forms, Inc. of Lake Forest, Ill. sold under the trademark "SpeediSealer". The intermediate at this stage may be as illustrated generally by reference numeral 25 in FIG. 4.

Figure 5:
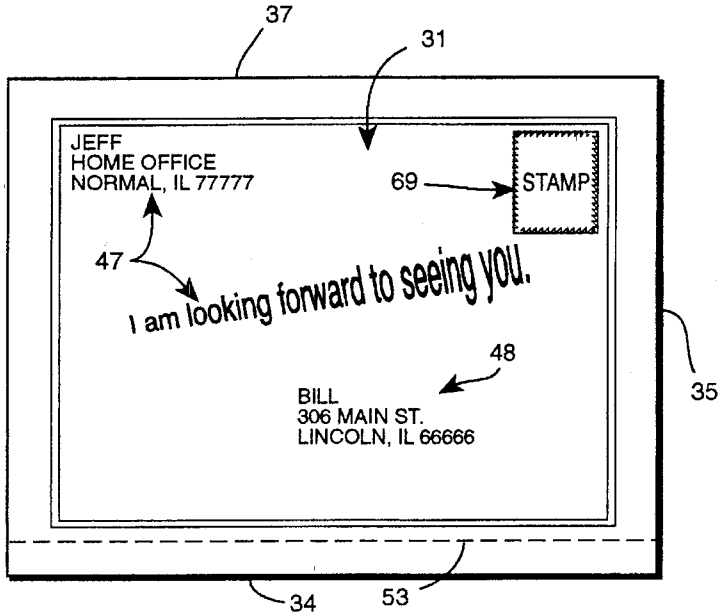
FIG. 5 is a top plan view of the completed mailer according to the present invention formed from the intermediate of FIGS. 2 through 4.

The intermediate 25 is then folded about a longitudinal fold line as illustrated schematically by box 26 in FIG. 1, and then again passed through a conventional pressure sealer as indicated by box 27. The final mailer produced may then have the appearance as illustrated schematically at 28 in FIG. 5. The final mailer 25 is then suitable for being mailed, as indicated by box 29 in FIG. 1, postage being applied directly thereto (e.g. by a postage meter, stamps, preprinted postage authorization code, or the like), without the necessity of using an envelope.

The method as illustrated in FIG. 1 may have a wide variety of variations and produce a wide variety of intermediates and mailers. For example, the folding steps 23, 26 may be consecutive, and the pressure sealing (steps 24 and 27 being combined) being practiced after both the folding steps 23, 26. While the production of mailers from 8½×11 or A4 sheets is preferred, a wide variety of different sheets may be utilized, and finer mailers produced may be optionally (only typically less desirably) produced from two sheets rather than a single sheet.

An exemplary intermediate 21 according to the present invention is illustrated in FIGS. 2 and 3. The intermediate 21 includes a front face 31 (FIG. 2) and a back face 32 (FIG. 3). The intermediate is formed from a single sheet of paper that is quadrate in configuration, having longitudinal edges 33, 34 which are parallel to each other and transverse edges 35, 36 which are parallel to each other and transverse to the longitudinal edges 33, 34. In the preferred embodiment illustrated, the longitudinal edges 33, 34 have a length of approximately 11 inches, while the transverse edges 35, 36 have a length of approximately 8½ inches.

The score/fold assist perf/or other fold lines that are formed by step 14 of FIG. 1 preferably comprise a first fold line 37, which is parallel to the longitudinal edges 33, 34 and substantially bisects the transverse edges 35, 36, and a second fold line 38 which is parallel to the transverse edges 35, 36 and essentially bisects the longitudinal edges 33, 34. The die cut pop-ups 40, 41 are formed on opposite sides of the first fold line 37, and in operative alignment with each other when the intermediate 21 is ultimately folded about the first fold line 37. The die cut 40 is integral with the sheet of paper forming the intermediate 21 only at the base 42 thereof, which may comprise a fold assist perf (such as applied at stage 12 in FIG. 1), while the pop-up 41 is integral with the sheet forming the intermediate 21 only at the base 43 thereof, again which may be formed by a fold assist perf. Normally, the bases 42, 43 are substantially parallel to each other and to the fold line 37, but other configurations may be provided under special circumstances. Also, if desired, during the practice of step 12 another fold assist perf 44 may be formed in one or both of the pop-ups (being shown formed in the pop-up 41 in FIG. 2), the fold assist perf 44 being parallel to the base 43 and spaced therefrom.

A pattern of coadhesive on one or both of the pop-ups 40, 41—applied in stage 11—is illustrated by the strips 45, 46 in FIG. 2. Other patterns besides the strips 45, 46 may be utilized, and under some circumstances only one of the strips 45, 46 may be provided, although with conventional pressure coadhesive such as that available from Toppan Moore Co., Ltd. under the trade designation "TN-124", better results are obtained by providing cooperating patterns 45, 46 rather than a single pattern.

The front face 31 of the intermediate 21 also includes non-variable human readable indicia, such as the indicia 47 illustrated in FIG. 2. This is applied at stage 16 of FIG. 1. Also variable human readable indicia, such as the indicia 48 in FIG. 2, applied in stage 22 from FIG. 1, may be provided.

The intermediate 21 front face 31 of FIG. 2 also includes perimeter coadhesive patterns, such as the patterns 50, 51 adjacent the longitudinal edges 33, 34, and the perf lines 52, 53 (applied in stage 13 of FIG. 1) may be provided parallel to the edges 33, 34 and on the opposite sides thereof from the pressure coadhesive patterns 50, 51.

The back face 32 of the intermediate 21—as illustrated in FIG. 3—includes perimeter pressure coadhesive patterns applied at stage 17 of FIG. 1. Normally these coadhesive patterns will include at least the patterns 55, 56 which are adjacent the longitudinal edges 33, 34 and exterior of the perforation lines 52, 53, respectively. In order to provide the most secure mailer desired, however, additional pressure cohesive patterns may be provided, such as the patterns 57, 58 adjacent the transverse edges 35, 36, respectively, as well as the pattern 59, 60 straddling the first fold line 37. Also—as indicated applied at stage 19 IN FIG. 1—in order to maintain one or both of the pop-ups 40, 41 in the plane of the paper forming the intermediate 21, adhesive may be applied along one or more edges of the pop-ups 40, 41. The adhesive applied must not interfere with the pop-up action. In the embodiment illustrated in FIG. 3, simply for illustrative purposes, a single pattern of adhesive 62 is illustrated, along one edge of the pop-up 40. The adhesive 62 may be silicone adhesive, or may be pressure coadhesive, and it provides just enough of a bond between the die cut pop-up 40 and the surrounding paper to hold the die cut 40 in the plane of the paper during variable imaging at stage 22, or the like, but does not interfere with the ultimate pop-up function.

Finally, FIG. 3 illustrates indicia 64 which is provided in the pop-up area. In the embodiment illustrated in FIG. 3 the indicia 64 (in the form of a caricature of an owl) is shown applied just to the pop-up 40, but obviously the same or other indicia may be provided on the pop-up 41 back face 32, depending upon the particular message being conveyed or the like, and the particulars of the pop-up constructions. The indicia 64 may be applied either at stage 18 in FIG. 1, stage 22, or parts of the indicia applied in both stages.

Illustrated in both FIGS. 2 and 3, the area between the fold lines 37, 38 and the transverse edge 36 may be considered to be first and second panels 66, 67, respectively, the panels 66, 67 being the interior panels which are being exposed and visible when the mailer 28 formed from the intermediate 21 is opened.

Figure 4:
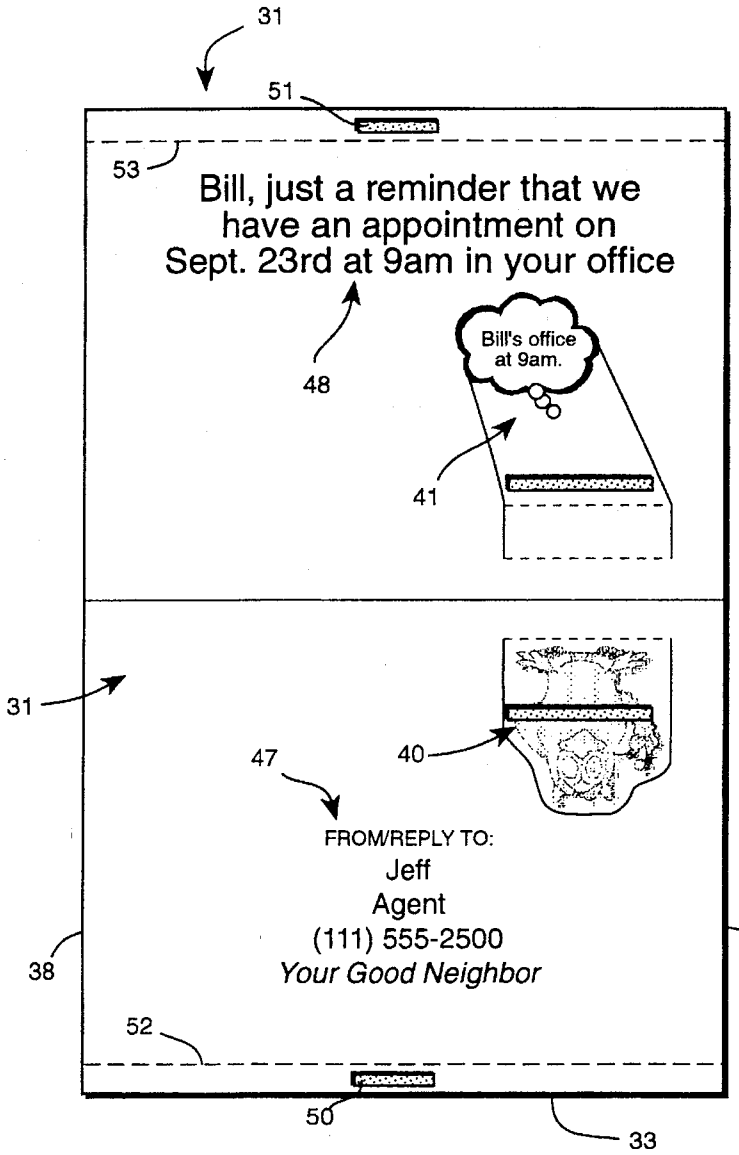
FIG. 4 is a top plan view of the intermediate of FIGS. 2 AND 3 after having been folded about a transverse fold line.

In the construction of the mailer 28 from the intermediate 21, as earlier indicated, the intermediate 21 is first folded about the second, transverse fold line 38 so that it has the configuration 25 illustrated in FIG. 4. In this configuration 25, the intermediate is passed through the pressure sealer, as indicated at stage 24 in FIG. 1. Then the intermediate 25 is folded about the fold line 37 to bring the indicia 47, 48 on the panels 66, 67 into face to face engagement with each other, and then again passed through a pressure sealer indicated at stage 27 in FIG. 1. The final mailer 28 is thus produced. The mailer 28 preferably has a predetermined postage application area 69, which may include indicia indicating that postage is to be applied there, a postal account number, or the like.

In the mailer 28 there are two plies, the first ply formed by the panels 70, 71 (see FIG. 2) and the second ply formed by the panels 66, 67. It is preferred that the plies be formed of the same integral sheet, connected at fold line 38, although under some circumstances the mailer can be formed where the plies are separate. In any event, the fold line 37 forms the panels 66, 67 from the second ply, the faces corresponding to the front face 31 of the panel 66, 67 being in engagement with each other. The outer face of the first ply includes the indicia 47, 48 in the panel 71.

Figure 6:
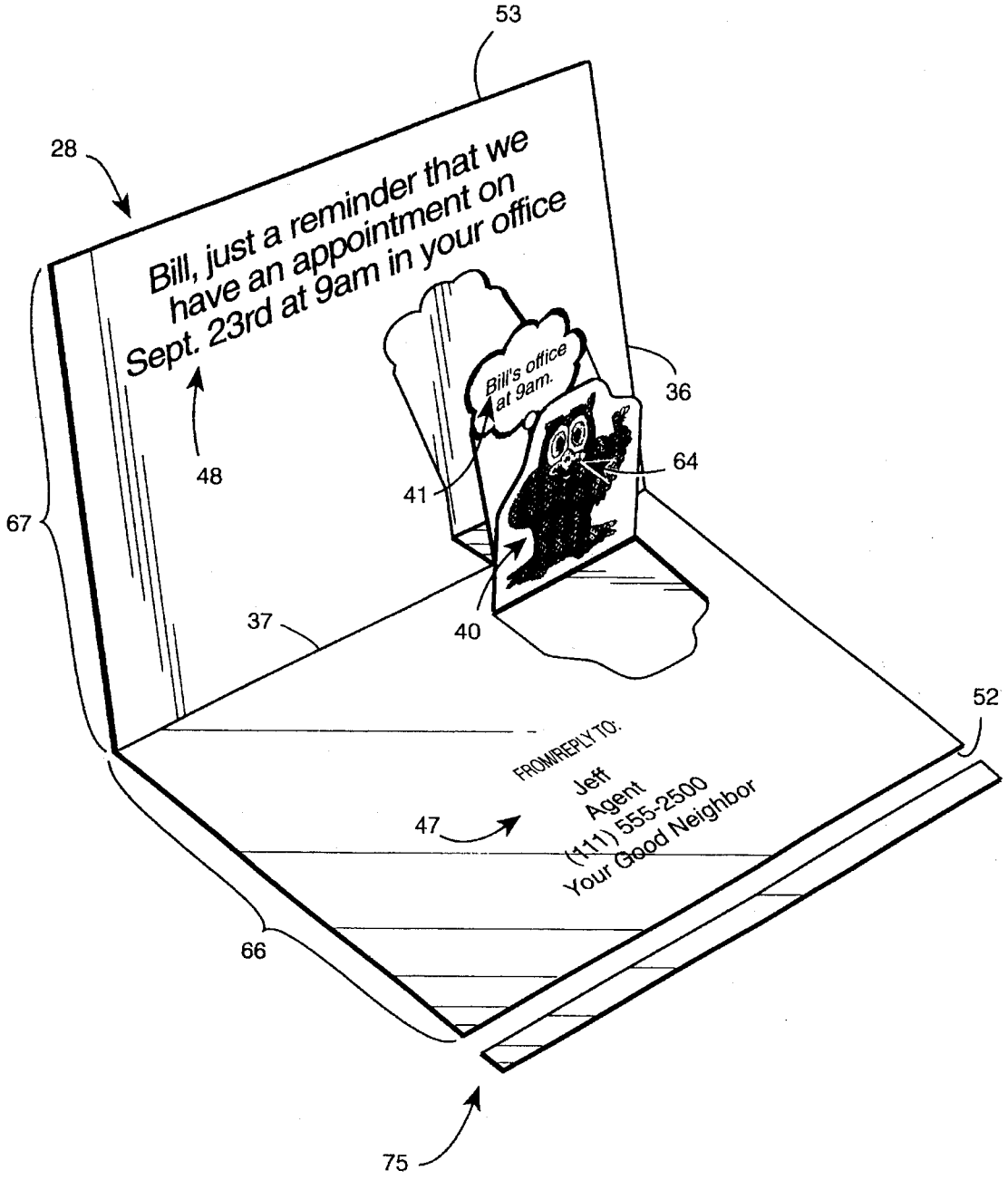
FIG. 6 is a top perspective viewing showing the mailer of FIG. 5 after it has been opened.

In the mailer 28, the coadhesive patterns 50, 51 may be small enough that the mailer may be opened merely by sticking one's finger or an object between the panels 66, 67, and separating the panels 66, 67, the adhesive 50, 51 because of the small extent of allowing this separation. In the embodiment illustrated in the drawings, however, in order to facilitate opening of the mailer 28 the mailer 28 is torn at the perforation lines 52, 53, separating the stub 75 (see FIG. 6) from the rest of the mailer 28 and exposing the interior. When the panels 66, 67 are folded about the fold line 37 to expose the interior, because the pop-ups 40, 41 are connected by the adhesive strips 45, 46, they will "pop out" of the plane of the panels 66, 67 providing a positive attention getting mechanism.

It will thus be seen that according to the present invention an advantageous method of making a pop-up construction in such a simple and cost effective manner that it is readily utilizable for common mailings, both in business and personal use, is provided. Also, an effective, yet simple, mailer intermediate, and final mailer, are provided. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent processes and products.

What is claimed is:

1. A method of making a pop-up mailer from a quadrate single sheet of paper having a front face and a back face, longitudinal edges and transverse edges, comprising the steps of:

(a) die cutting at least two pop-ups from the quadrate sheet of paper;

(b) forming a first fold line separating the two pop-ups from each other;

(c) applying pressure coadhesive to the front face of a portion of at least one of the pop-ups;

(d) applying pressure coadhesive to the front face adjacent at least one longitudinal edge;

(e) applying pressure coadhesive to the back face of the sheet adjacent at least one longitudinal and one transverse edge thereof;

(f) forming a second fold line perpendicular to the first fold line;

(g) after steps (a)–(f), folding the sheet about one of the first and second fold lines to bring portions of the back face into contact with each other to form an intermediate;

(h) after step (g), applying pressure to the intermediate to seal the intermediate;

(i) after step (g), folding the sheet about the other of the first and second fold lines to bring the portions of the front face containing the at least two pop-ups into contact with each other; and (j) after step (i), applying pressure to the folded sheet to seal the from face portions into contact with each other, and the portions of the pop-ups with coadhesive to each other to produce a mailer.

2. A method as recited in claim 1 comprising the further step, after step (j), of applying postage directly to the mailer, and mailing it.

3. A method as recited in claim 1 wherein step (i) is practiced after step (h).

4. A method as recited in claim 1 wherein step (a) is practiced before steps (b)–(f).

5. A method as recited in claim 4 comprising the further step (k) of applying adhesive around the die cuts produced in the practice of step (a) to assist in maintaining the pop-ups within the plane defined by the paper sheet during the practice of subsequent steps.

6. A method as recited in claim 5 wherein step (k) is practiced by applying pressure coadhesive around the die cuts.

7. A method as recited in claim 1 comprising the further step of (k) non-impact imaging the front face of the sheet with variable indicia prior to the practice of step (g).

8. A method as recited in claim 7 comprising the further step (l) of applying adhesive around the die cuts produced in the practice of step (a) to assist in maintaining the pop-ups within the plane defined by the paper sheet during the practice of subsequent steps.

9. A method as recited in claim 7 comprising the further step (1) of applying postage directly to the mailer, and mailing it.

10. A method as recited in claim 7 comprising the further step of nonimpact imaging the pop-ups on the back face of the sheet.

11. A method as recited in claim 1 wherein the sheet of paper is an approximately 8.5×11 inch or A4 sheet having a weight of at least 20 lbs. per sheet ream, and less than conventional greeting card stock.

12. A method as recited in claim 1 comprising the further step of forming perf lines adjacent, but spaced from, the transverse edges, and wherein step (d) is practiced to apply pressure coadhesive between the perf lines and the longitudinal edges; and wherein step (f) is practiced by applying the second fold line parallel to the transverse edges and essentially bisecting the longitudinal edges; and step (g) is practiced by folding about the second fold line, and step (i) is practiced by folding about the first fold line.

13. A mailer comprising:

a first ply having an outer face and an inner face;

a second ply having first and second faces, said first face in face-to-face engagement with said inner face of said first ply;

first human readable indicia on said first ply outer face;

a first pattern of pressure coadhesive holding said first ply inner face to said second ply first face;

said second ply having first and second panels separated by a fold line;

second human readable indicia on at least one of said panels of said second ply second face;

a first pop-up formed in said first panel and a second pop-up formed in said second panel, each pop-up having a base integral with said first and second panels, respectively;

a second pattern of pressure coadhesive holding portions of said first and second pop-ups together at an area spaced from said bases of each; and a third pattern of pressure coadhesive releasably holding said first panel second face to said second panel second face.

14. A mailer as recited in claim 13 wherein said first and second plies are integral along an edge thereof, said mailer formed from a single sheet of paper.

15. A mailer as recited in claim 14 wherein said single sheet of paper has a weight of at least about 20 lbs per 1000 sheet ream; and further comprising a fold assist perf in at least one of said pop-ups spaced from said base thereof.

16. A mailer as recited in claim 13 further comprising perforation lines formed in said first and second plies adjacent, but spaced from, edges thereof parallel to said fold line; and wherein said third pattern of pressure coadhesive is between said edges and said perforation lines.

17. A mailer as recited in claim 13 further comprising a predetermined postage application area on said first ply outer face.

18. An intermediate for a mailer, comprising:

a single quadrate sheet of paper having longitudinal edges, transverse edges perpendicular to said longitudinal edges, a front face, and a back face;

a first fold line parallel to said longitudinal edges and essentially bisecting said transverse edges;

a second fold line parallel to said transverse edges and essentially bisecting said longitudinal edges;

a first pattern of pressure coadhesive on said back face including adjacent at least one of said longitudinal edges and adjacent at least one of said transverse edges;

at least first and second die cut pop-ups formed on aligned on opposite sides of one of said fold lines, each having a base integral with said sheet;

a second pattern of pressure coadhesive on at least one of said first and second pop-ups remote from said base thereof;

human readable indicia on said front face, and on said back face of at least one of said pop-ups; and a third pattern of pressure coadhesive on said front face adjacent at least one of said longitudinal or transverse edges.

19. An intermediate as recited in claim 18 wherein said single sheet of quadrate paper comprises an approximately 8.5×11 inch or A4 sheet having a weight of at least 20 lbs. per 1000 sheet ream, and less than that of conventional greeting card stock.

20. An intermediate as recited in claim 18 wherein said first and third patterns of pressure coadhesive are adjacent and parallel to longitudinal edges of said sheet, and wherein said pop-ups are on opposite sides of said first fold line; and further comprising perforation lines parallel to said longitudinal edges on the opposite side of said first and third patterns of pressure coadhesive from said longitudinal edges.

21. An intermediate as recited in claim 18 wherein each of said bases for said pop-ups comprises a fold assist line.

22. A method of making a pop-up mailer from a quadrate single sheet of paper having a front face and a back face, longitudinal edges and transverse edges, comprising the steps of:

(a) die cutting at least two pop-ups from the quadrate sheet of paper;

(b) forming a first fold line separating the two pop-ups from each other;

(c) applying adhesive to the front face of a portion of at least one of the pop-ups;

(d) applying adhesive to the front face adjacent at least one longitudinal edge;

(e) applying adhesive to the back face of the sheet adjacent at least one longitudinal and one transverse edge thereof;

(f) forming a second fold line perpendicular to the first fold line;

(g) applying adhesive around the die cuts produced in the practice of step (a) to assist in maintaining the pop-ups within the plane defined by the paper sheet during the practice of subsequent steps;

(h) folding the sheet about the first and second fold lines; and (i) sealing the adhesive to produce a mailer.

23. A method as recited in claim 22 comprising a further step, after step (i) of applying postage directly to the mailer, and mailing it.

* * * * *